US007210417B2

(12) United States Patent
Koerner

(10) Patent No.: US 7,210,417 B2
(45) Date of Patent: May 1, 2007

(54) STITCHING METHOD AND APPARATUS EMPLOYING THREAD PAYOUT DETECTION

(76) Inventor: Ralph James Koerner, P.O. Box 1320, Ramona, CA (US) 92065

( * ) Notice: Subject to any disclaimer, the term of this patent is extended or adjusted under 35 U.S.C. 154(b) by 0 days.

(21) Appl. No.: 11/443,563

(22) Filed: May 31, 2006

(65) Prior Publication Data

US 2006/0213413 A1 Sep. 28, 2006

Related U.S. Application Data

(63) Continuation of application No. PCT/US05/46830, filed on Dec. 21, 2005.

(60) Provisional application No. 60/638,959, filed on Dec. 24, 2004.

(51) Int. Cl.
*D05B 51/00* (2006.01)

(52) U.S. Cl. ..... 112/278

(58) Field of Classification Search ..... 112/278, 112/61.16, 273, 559.4, 559.43
See application file for complete search history.

(56) References Cited

U.S. PATENT DOCUMENTS

| | | | | |
|---|---|---|---|---|
| 5,103,750 | A * | 4/1992 | Sato et al. | 112/278 |
| 5,651,324 | A * | 7/1997 | Arnold | 112/278 |
| 6,564,733 | B2 * | 5/2003 | Butzen et al. | 112/273 |
| 6,810,824 | B2 * | 11/2004 | Durville | 112/278 |
| 6,863,007 | B2 * | 3/2005 | Fluckiger | 112/475.01 |

* cited by examiner

*Primary Examiner*—Danny Worrell
(74) *Attorney, Agent, or Firm*—Freilich, Hornbaker & Rosen

(57) ABSTRACT

A method and apparatus for producing uniform stitches in a stack of fabric layers while allowing a user to manually guide the stack across a planar surface beneath a stitch head. Stitch head actuation is controlled as a function of the rate of thread payout.

23 Claims, 11 Drawing Sheets

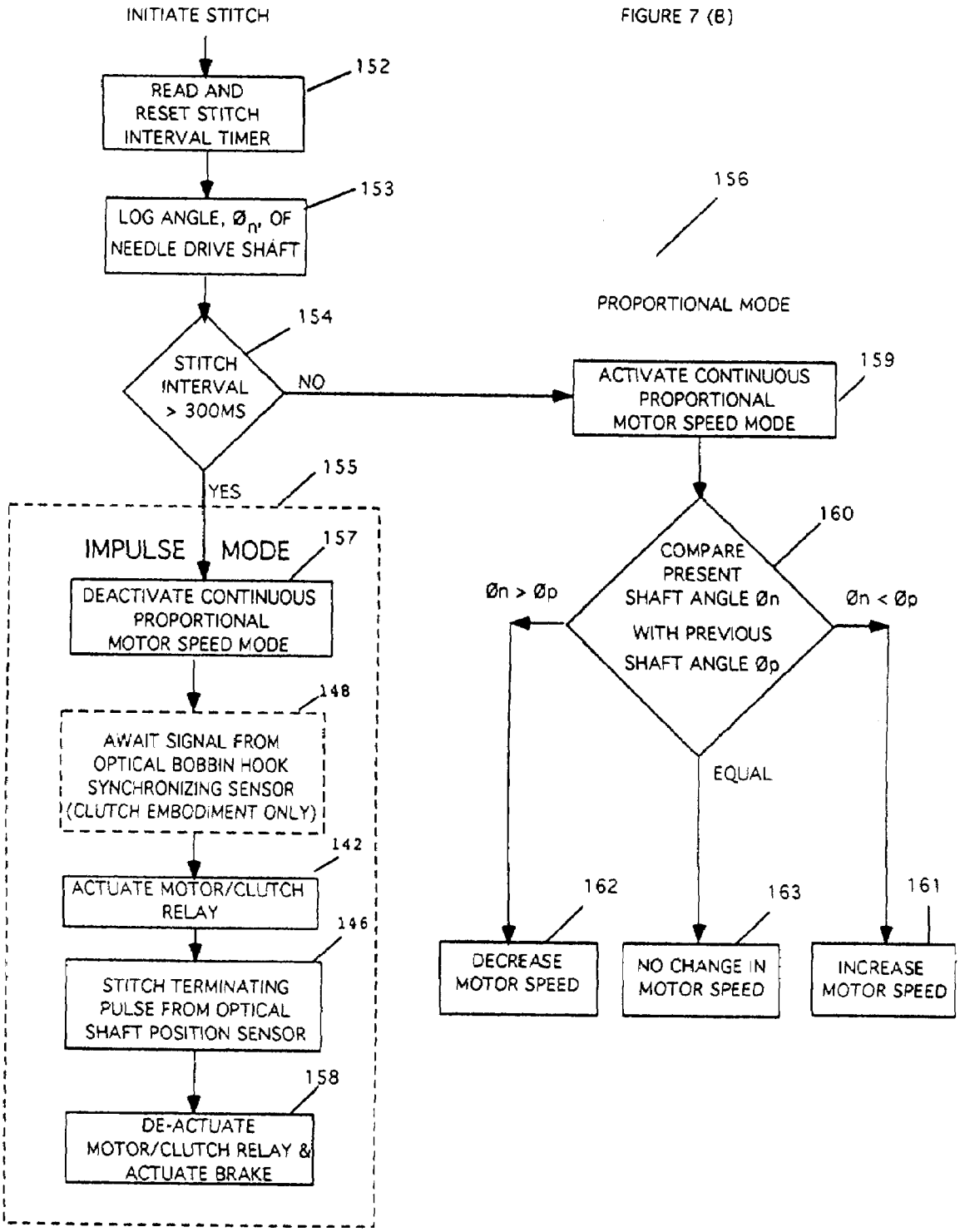
INITIATE STITCH
FIGURE 7 (B)
READ AND RESET STITCH INTERVAL TIMER
152
LOG ANGLE, Ø$_n$, OF NEEDLE DRIVE SHAFT
153
156
PROPORTIONAL MODE
154
STITCH INTERVAL > 300MS
NO
ACTIVATE CONTINUOUS PROPORTIONAL MOTOR SPEED MODE
159
YES
155
IMPULSE MODE
157
DEACTIVATE CONTINUOUS PROPORTIONAL MOTOR SPEED MODE
160
COMPARE PRESENT SHAFT ANGLE Øn WITH PREVIOUS SHAFT ANGLE Øp
Øn > Øp
Øn < Øp
148
AWAIT SIGNAL FROM OPTICAL BOBBIN HOOK SYNCHRONIZING SENSOR (CLUTCH EMBODIMENT ONLY)
EQUAL
142
ACTUATE MOTOR/CLUTCH RELAY
162
163
161
146
STITCH TERMINATING PULSE FROM OPTICAL SHAFT POSITION SENSOR
DECREASE MOTOR SPEED
NO CHANGE IN MOTOR SPEED
INCREASE MOTOR SPEED
158
DE-ACTUATE MOTOR/CLUTCH RELAY & ACTUATE BRAKE

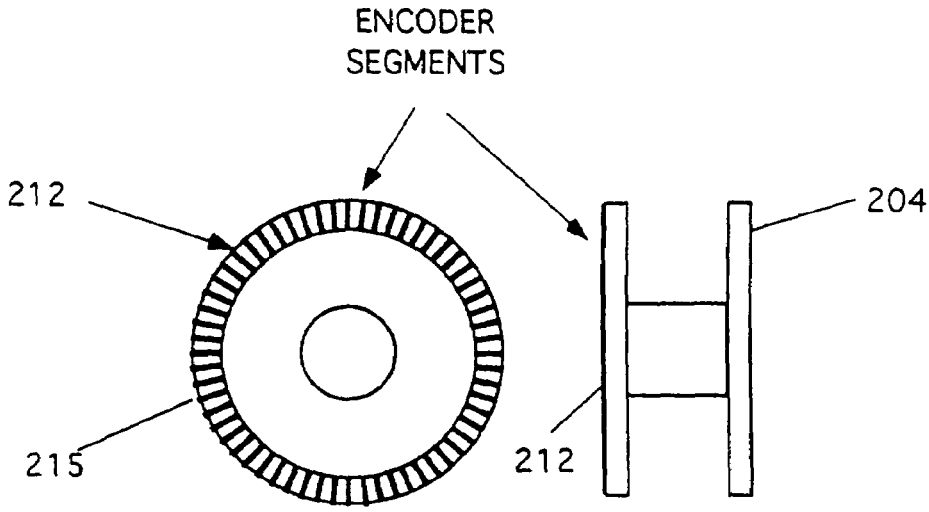
FIGURE 9A
FIGURE 9B
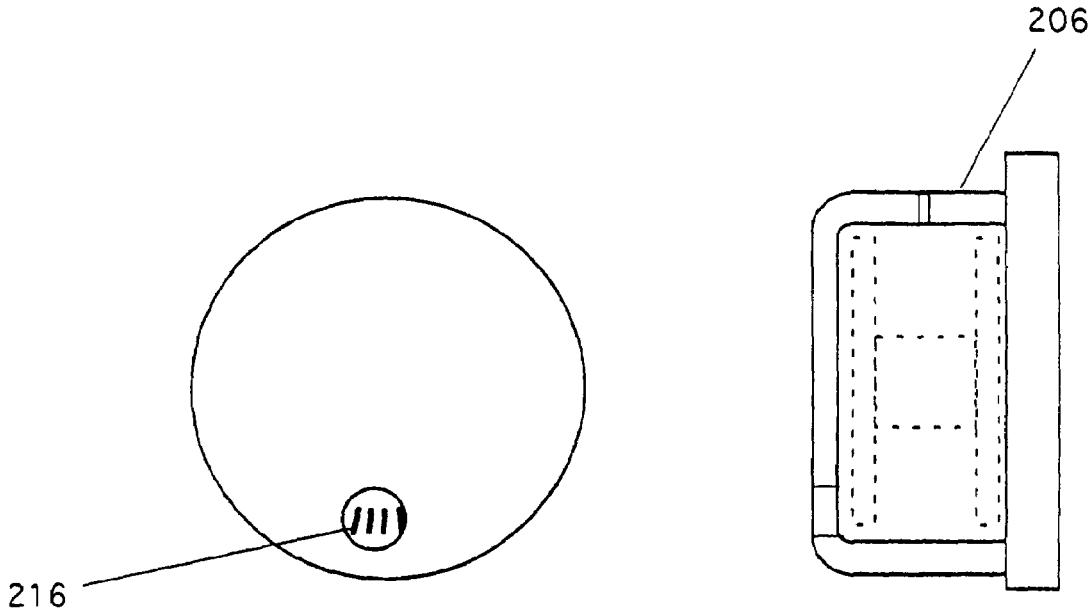
FIGURE 10A
FIGURE 10B

STITCHING METHOD AND APPARATUS EMPLOYING THREAD PAYOUT DETECTION

RELATED APPLICATIONS

This application is a continuation of PCT Application PCT/US2005/046830 filed on 21 Dec. 2005 which claims priority based on U.S. Provisional Application 60/638,959 filed on 24 Dec. 2004. This application claims priority based on both of said aforementioned applications which are incorporated herein by reference.

FIELD OF THE INVENTION

This invention relates to a method and apparatus for producing uniform stitches in a stack of fabric layers while allowing a user to manually guide the stack across a planar surface beneath a stitch head.

BACKGROUND OF THE INVENTION

Applicant's prior U.S. application Ser. No. 10/776,355 (now U.S. Pat. No. 6,883,446) which is incorporated herein by reference, describes an apparatus which permits a user to manually move a stack of fabric layers across a planar bed beneath an actuatable stitch head. The apparatus includes a detector for detecting the movement of the stack for the purpose of synchronizing the delivery of stitch strokes to the stack movement. This approach enables the insertion of uniform length stitches while allowing the user to freely move the stack within a wide range of speeds, to start or stop the stack movement at will, and to guide the stack in any direction across the planar bed.

The preferred embodiments described in said U.S. Pat. No. 6,883,446 employ a detector configured to detect stack movement within the throat space of a quilting/sewing machine by measuring the movement of at least one surface of the stack as it moves across the planar bed. As described, a preferred detector responds to energy, e.g., light, reflected from a target area on the stack surface (top and/or bottom) within the machine's throat space. The detector preferably provides output pulses representative of incremental translational movement of the stack along perpendicular X and Y directions. The output pulses are processed to determine the distance the stack moves. When the stack movement exceeds a threshold magnitude, a "stitch stroke" command is issued to cause the stitch head to insert a stitch through the stacked layers. As the user continues to move the stack across the planar bed, additional stitch stroke commands are successively issued to produce successive stitches.

Applicant's U.S. Pat. No. 6,883,446 primarily contemplates that a user directly grasp, or touch, the stacked fabric layers to push and/or pull the stack across the planar bed. However, the application also recognizes that the user could, alternatively, mount the stack on a conventional quilt frame and then grasp the frame to move the stack across the planar bed to enable the detector to sense stack surface movement.

Applicant's U.S. Application 60/571,109 filed 14 May 2004, which is incorporated herein by reference, describes alternative embodiments for controlling stitch head actuation which involve using a frame for mounting the fabric layer stack to retain it in a substantially taut condition. The frame is supported for user guided movement beneath a fixedly located stitch head and a detector is provided to produce signals representing the magnitude of frame translation, and thus the magnitude of stack translation.

SUMMARY OF THE INVENTION

The present invention is directed to a further method and apparatus for controlling stitch head actuation as a function of stack movement. More particularly, the present invention is based on the recognition that inasmuch as thread is pulled, or paid out, from a bobbin in direct relationship to the movement of the stack, the length of thread payout can be detected and used to control stitch head actuation. In accordance with a preferred embodiment, control circuitry is provided to respond to the payout of a threshold length of bottom thread to actuate the stitch head, i.e., cause the stitch head needle to execute a cyclic movement. Alternatively, the control circuitry can respond to top thread payout. As a consequence, uniform length stitches can be produced as the stack is freely manually guided across the planar bed.

In accordance with a first preferred embodiment, the rotational motion of the bobbin which supplies the bottom thread is measured in order to determine thread payout length. The rotational bobbin motion is preferably measured by providing an encoder disc on the bobbin which rotates relative to a sensor, e.g., optical, magnetic, etc.

In accordance with a further preferred embodiment, the bottom thread payout is directly sensed by reading characteristics of the thread or markings formed on the thread. For example, the thread can be marked with invisible bands spaced along its length which fluoresce when illuminated by ultraviolet light. An optical sensor is provided to detect these fluorescent markings as they move away from the bobbin.

Various other techniques can also be employed to measure the length of thread payout. For example, the thread can engage and rotate an idler pulley as the thread is pulled from the bobbin and the incremental rotation of the pulley can be detected to determine the length of thread payout. Regardless of the particular means used to measure thread payout length, embodiments in accordance with the invention function to synchronize needle cycles to the rate of thread payout.

BRIEF DESCRIPTION OF THE FIGURES

FIG. 1 is a generalized block diagram depicting a system for fastening stacked planar layers;

FIG. 2 is a diagrammatic illustration of an embodiment of the system of FIG. 1 utilizing a motor/brake assembly to control a stitch head in response to movement of a stack of fabric layers;

FIG. 3 and is a diagrammatic illustration showing the stitch needle and hold-down plate of FIG. 2 in their down position;

FIG. 4 is a diagrammatic illustration similar to FIG. 3 but showing the needle and hold-down plate in their up position;

FIGS. 5 and 6 respectively show side and end views of an exemplary quilting/sewing machine housing;

FIG. 7 (presented as 7 A and 7 B) comprises a flow chart depicting dual mode operation, i.e., (1) impulse mode and (2) proportional mode;

FIGS. 9A and 9B comprise front and side views showing a bobbin and an encoder disc mounted on the bobbin for use in the embodiment of FIG. 8;

FIGS. 10A and 10B comprise front and side views showing the bobbin and encoder disc mounted in a case having a window so that the encoder disc can be viewed from outside of the case;

DETAILED DESCRIPTION

Figure 1:
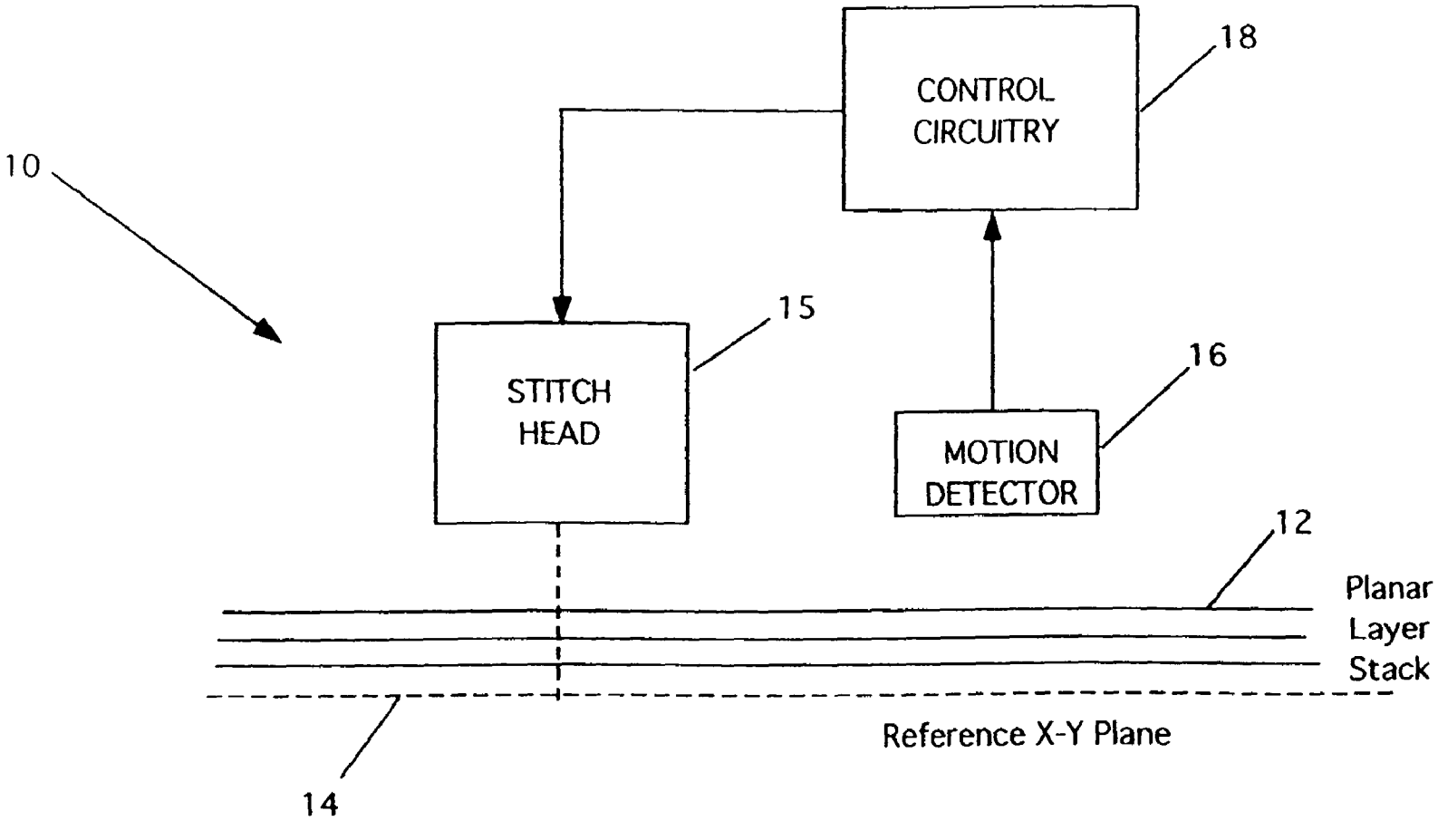
FIGS. 1–7 herein correspond to figures in U.S. Pat. No. 6,883,446.

U.S. application Ser. No. 10/776,355 (now U.S. Pat. No. 6,883,446) is in its entirety incorporated herein by reference. However, for convenience sake, several of the figures and related text from the '355 application are expressly reproduced in this application, e.g., FIGS. 1–6, and 7(A), 7(B) herein respectively correspond to FIGS. 1–6, and 11(A), 11(B) of said '355 application. FIGS. 8–14 herein are first being introduced in this application Attention is initially directed to FIG. 1 which depicts a generalized system 10, as shown in said '355 application, for fastening together two or more flexible planar layers, e.g., fabric forming a stack 12. The stack 12 is supported for guided free motion along a horizontally oriented X-Y planar surface 14 proximate to a fastening, or stitch, head 15. The head 15 is actuatable to insert a stitch through the stacked layers 12. A motion detector 16 is provided to sense the movement of stack 12 across surface 14. Control circuitry 18 responds to increments of stack movement to actuate the head 15. The detector 16 is preferably configured to measure stack translational motion proximate to the stitch head 15.

Figure 2:
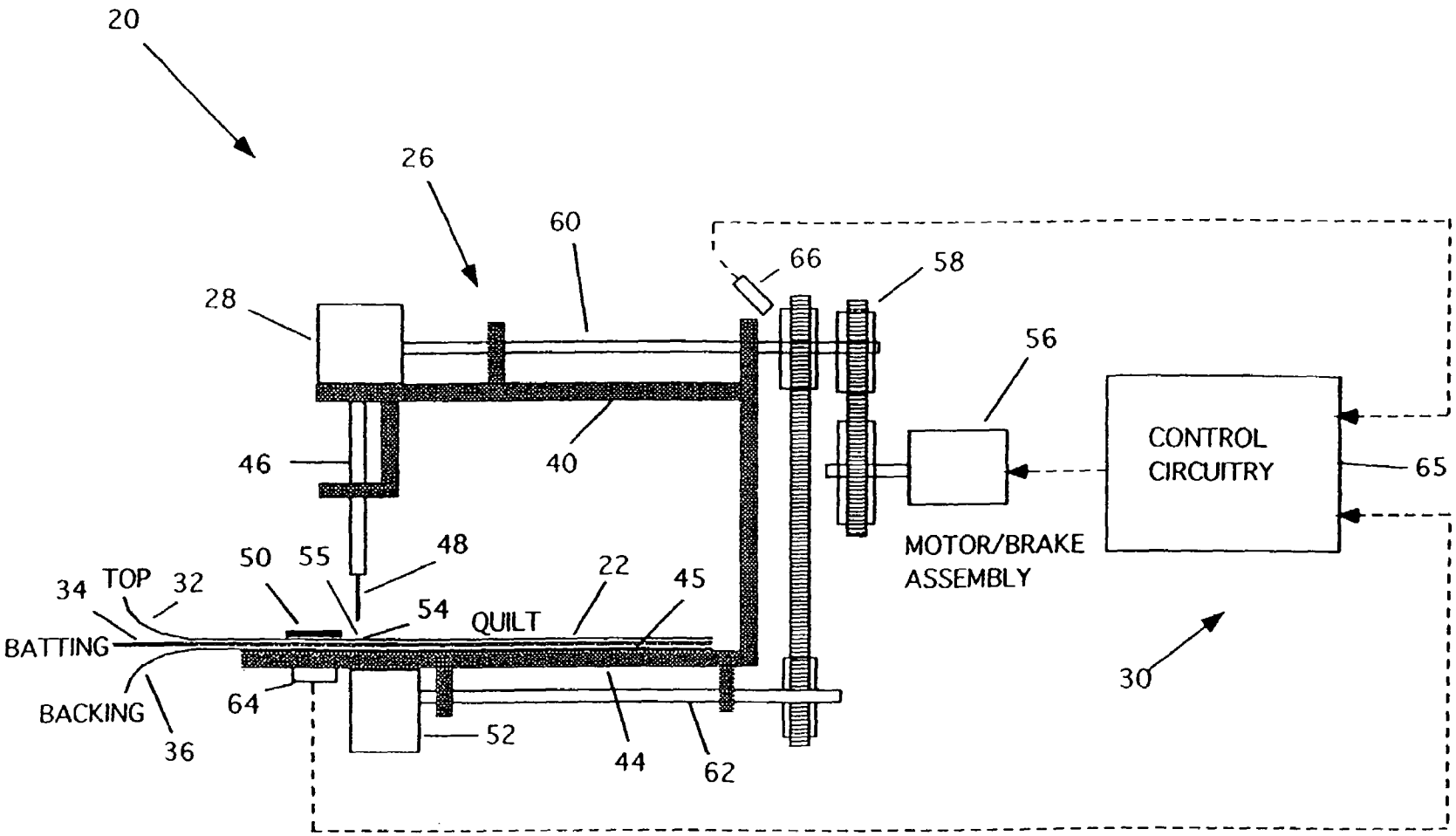

FIG. 2 illustrates an exemplary embodiment 20 of the system of FIG. 1 for stitching together fabric layers of a stack 22. The embodiment 20 is generally comprised of a mechanical machine portion 26, including an actuatable stitch head 28, and an electronic control subsystem 30 for actuating the head 28 in response to movement of the stack 22. The stack 22 is typically comprised of multiple fabric layers, e.g., a top layer 32, an intermediate batting layer 34, and a bottom backing layer 36, which when stitched together will form a quilt.

The machine portion 26 of FIG. 2 is depicted as including a machine frame 40 configured to support the stitch head 28 above a bed 44 providing a substantially horizontally oriented planar surface 45. The stitch head 28 includes a needle arm 46 supporting a needle 48 for reciprocal or cyclic vertical movement essentially perpendicular the planar surface 45. The bed surface 45 is configured for supporting the layered stack 22 so as to enable a user to directly grasp, the stack 22 for guiding it across the surface 45 by manual push-pull action. A hold-down plate, or presser foot, 50 is preferably provided to selectively press the stack 22 against the bed surface to assure proper stitch tension and to assist the needle to pull upwardly out of the stack after inserting a stitch.

Figure 4:
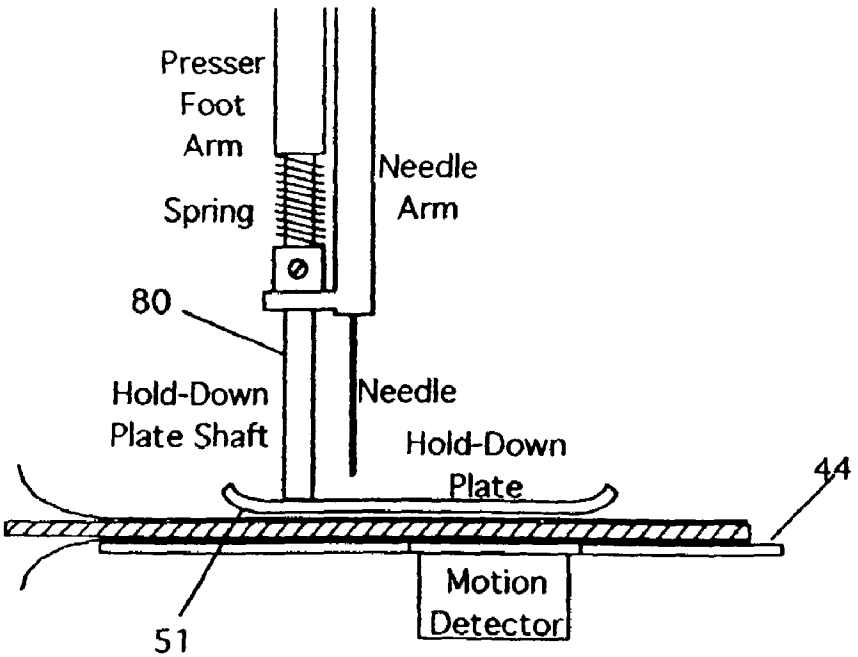

A conventional hook and bobbin assembly 52 is mounted beneath the bed 44 in alignment with the needle 48. The needle 48 operates in a conventional manner in conjunction with the hook and bobbin assembly 52 to insert a stitch through the stack 22 at a stitch site 54, i.e., an opening 55 in bed 44. When the needle 48 is lowered to its down position to pierce the stack layers (FIG. 3), the hold-down plate 50 is also lowered to press the stack layers against the bed 44 to achieve proper stitch tension and assist the needle to pull up out of the stack. After completion of a stitch cycle, the needle 48 and hold-down plate 50 are raised (FIG. 4).

The machine portion 26 of FIG. 2 is further depicted as including a motor/brake assembly 56 which functions to selectively provide operating power and braking via a suitable transmission system 58 to an upper drive shaft 60 and a lower drive shaft 62. The upper drive shaft 60 transfers power from the motor/brake assembly 56 to stitch head 28 for moving the needle 48. The lower drive shaft 62 transfers power from the motor/brake assembly 56 to the hook and bobbin assembly 52.

The stitch head 28 and hook and bobbin assembly 52 operate cooperatively in a conventional manner to insert stitches through stack 22 at stitch site 54. That is, when the stitch head cycle is initiated, needle 48 is driven downwardly to pierce the stacked layers 32, 34, 36 and carry a top thread (not shown) paid out through the needle through the stitch site opening 55 in bed 44. Beneath the bed 44, the hook (not shown) of assembly 52 grabs a portion of the top thread before the needle 48 pulls it back up through the stack. The top thread portion grabbed by the hook is then looped around a portion of bottom thread pulled off the bobbin of assembly 52 to lock the top and bottom threads together at the stack to form a stitch.

The system of FIG. 2 includes a transducer, or detector, 64 for detecting the movement, or more specifically, the translation of the stack 22 on bed 44 for the purpose of controlling the motor/brake assembly 56 via control circuitry 65. In operation, a user is able to freely move the stack 22 on bed 44 relative to the stitch head 28 while the detector 64 produces electronic signals representative of the stack movement. Control circuitry 65 then responds to the detected stack movement for controlling the issuance of a stitch from head 28. The control subsystem 30, in addition to including motion detector 64 and control circuitry 65, may also include a shaft position sensor 66. The shaft position sensor 66 functions to sense the particular rotational position of the upper drive shaft 60 corresponding to the needle 48 being in its full up position. The control circuitry 65 preferably responds to the output of sensor 66 to park the needle 48 in its full up position between successive stitch cycles. This action prevents the needle from interfering with the free translational movement of the stack 22 on bed 44.

In typical use of the apparatus of FIG. 2, an operator manually guides the fabric stack across the horizontally oriented bed 44 beneath the vertically oriented needle 48. The motion detector 64 is mounted to monitor a target area coincident with a surface layer (top and/or bottom) of the stack 22 as the stack is moved across the bed 44.

Although the motion detector 64 of FIG. 2 can take many different forms, including both noncontacting devices (e.g., optical detector) and contacting devices (e.g., track ball), it is preferred that it detect stack movement without physically contacting the fabric layers. Accordingly, a preferred motion detector 64, as discussed in said '355 application, comprises an optical motion detector utilizing, for example, an optical chip ADNS2051 marketed by Agilent Technologies.

Figure 3:
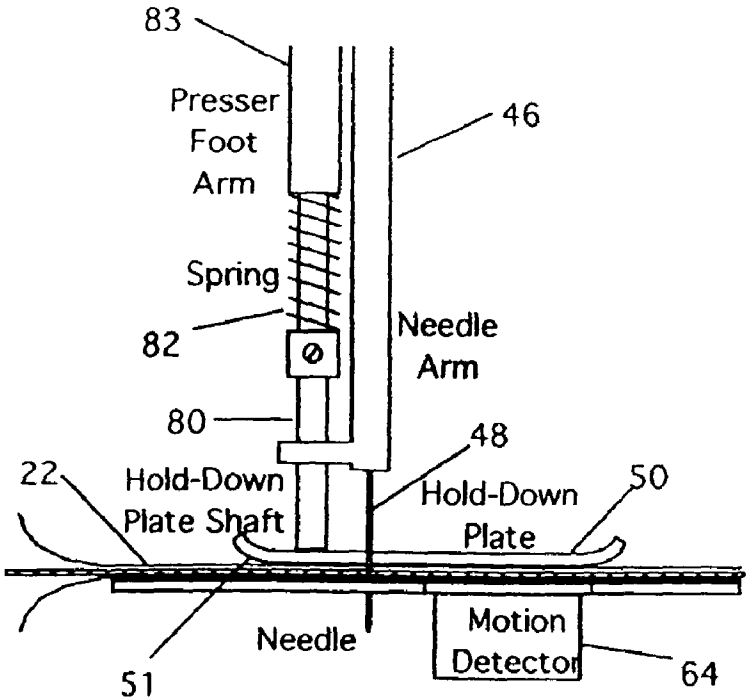

Suffice it to say that the accurate measurement of stack movement in FIG. 2, depends, in part, upon the stack target layer, e.g., backing layer 36, being positioned near the focus of the motion detector window. The aforementioned hold-down plate or presser foot 50 assists in maintaining the stack layers at a certain distance from the detector window. The hold-down plate 50 preferably has a flat smooth bottom surface 51 for engaging the stack 22 and is fabricated of transparent material to avoid obstructing a user's view of the stack layers proximate to the needle 48. FIGS. 3 and 4 respectively illustrate the actuated and non actuated positions of the hold-down plate 50. In FIG. 3, shaft 80 is moved down during the stitch cycle to cause the plate 50 to apply spring pressure, attributable to spring 82, to the stack 22. Between cycles (FIG. 4), shaft 80 is moved up so the pressure of plate 50 against stack 22 is relieved to reduce motion-inhibiting friction of the plate against the stack. Nevertheless, during a non-stitch interval between cycles, the plate 50 is positioned closely enough to loosely hold the stack against the bed 44.

Figure 5:
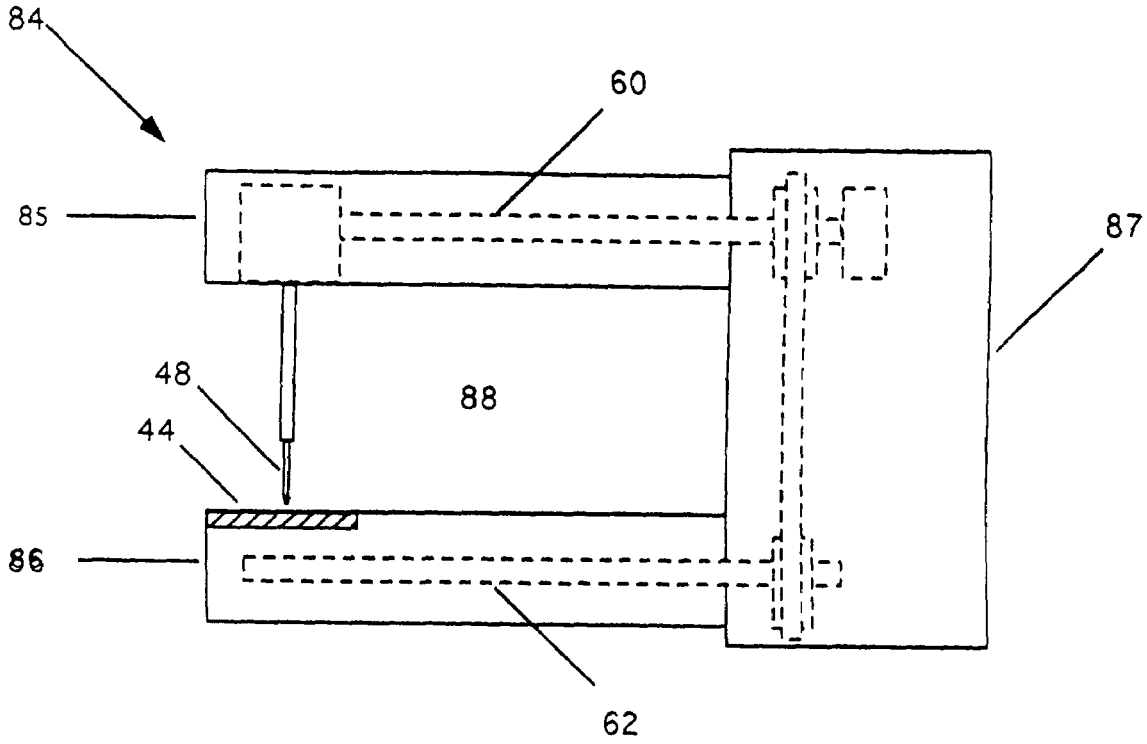
Figure 6:
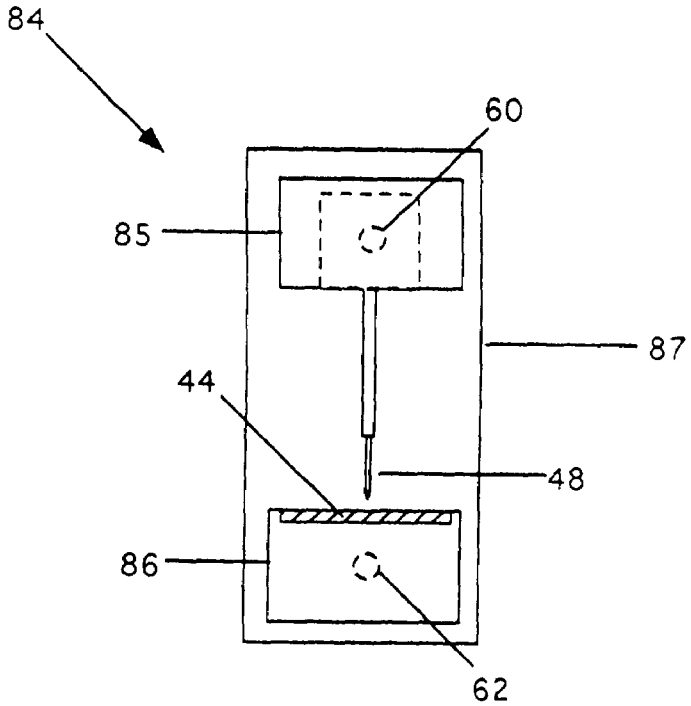

FIGS. 5 and 6 schematically depict a typical quilting/sewing machine housing 84 for accommodating the physical components of the system of FIG. 2. The housing 84 comprises an upper arm 85 which contains the upper drive shaft 60 and a lower arm 86 containing the lower drive shaft 62. The housing upper and lower arms 85 and 86 extend from a vertically oriented machine arm 87. The upper and lower arms 85, 86 are vertically spaced from one another and together with the machine arm 87 define a space which is generally referred to as the throat space 88. The needle 48 descends vertically from the upper arm into the throat space 88 for reciprocal movement toward and away from the lower arm 85. The lower arm 85 carries the bed 44 which is sometimes referred to as the throat plate. The distance between the needle and the machine arm is generally referred to as the throat length.

Figure 7:
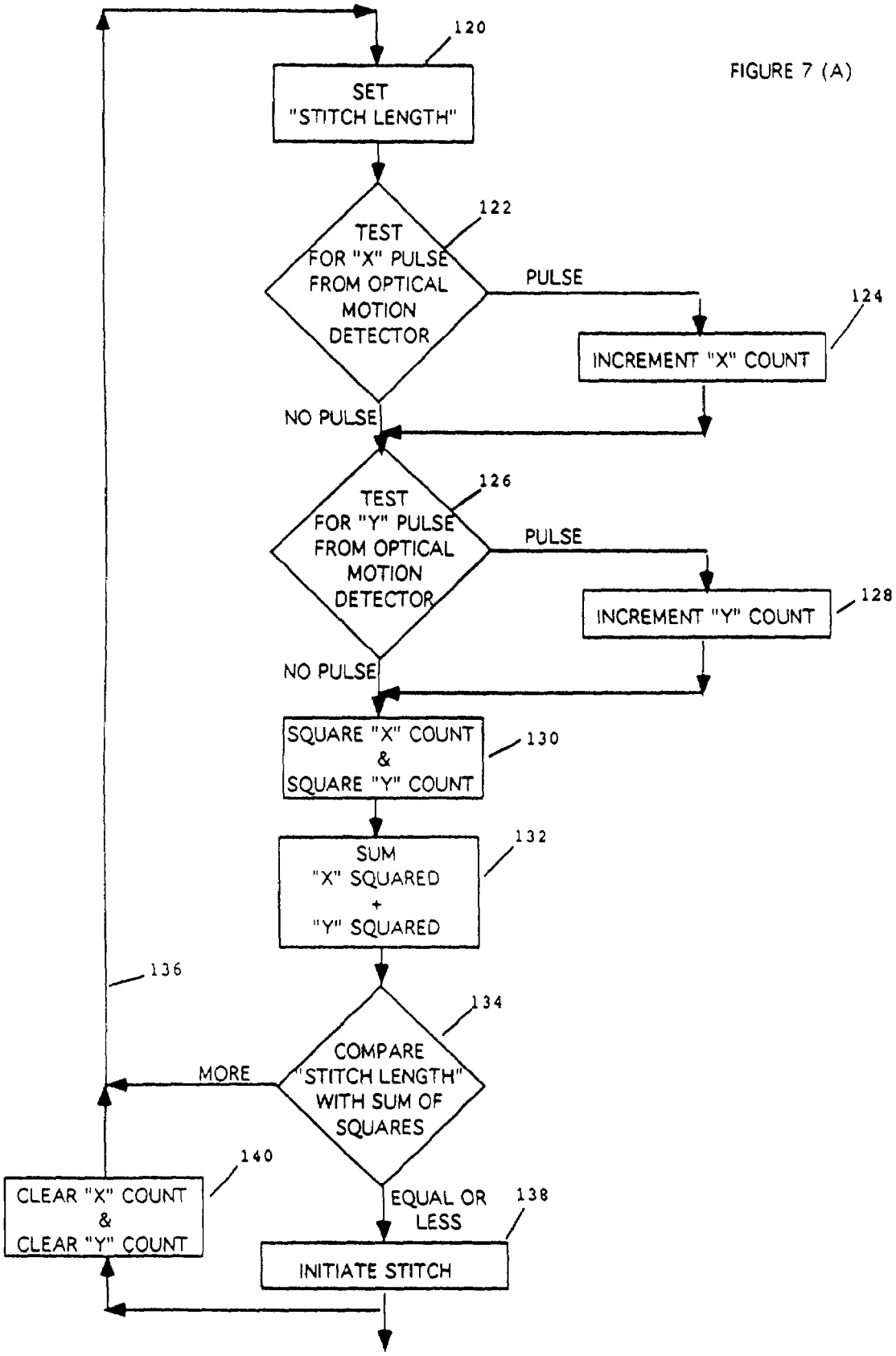

Attention is now directed to FIG. 7 (A, B) which comprises a flow diagram depicting an exemplary algorithmic operation of a microcontroller for controlling the motor/brake assembly 56 of FIG. 2. In FIG. 7, first note block 120 which functions to initialize a stitch cycle by acquiring a "stitch length" value which typically was previously entered via a user input. With the stitch length value set in block 120, the algorithm proceeds to decision block 122 which tests for stack translation in the X direction, i.e., for an X pulse on lead 96 from the optical chip 95. If a pulse is detected, then a store X count is incremented, as represented by block 124. After execution of blocks 122, 124, operation proceeds to decision block 126 which tests for Y translation, i.e., for a Y pulse out of the detector 64. If a Y pulse is detected, then a stored Y count is incremented as represented by block 128. Operation then proceeds from blocks 126 or 128 to block 130. Blocks 130 and 132 essentially represent steps for determining the resultant stack movement magnitude attributable to the measured X and Y components of motion utilizing the Pythagorean theorem. That is, in block 130, the X count value is squared and the Y count value is squared. Block 132 sums the squared values calculated in block 130 to produce a value representative of the resultant stack movement.

Block 134 compares the square of the preset switch length value with the magnitude derived from block 132. If the magnitude of the resultant movement is less than the preset stitch length, then operation cycles back via loop 136 to the initial block 120. If on the other hand, the resultant magnitude exceeds the preset stitch length, then operation proceeds to block 138 to initiate a stitch. In block 140, the X and Y counts are cleared before returning to the initial block 120.

FIG. 7 (A) as discussed thus far relates primarily to operation in the impulse, or single stitch, mode. FIG. 7B depicts dual mode operation, i.e., impulse mode at slow stack speeds and a continuous proportional mode at higher stack speeds. It is preferable to provide such a dual mode capability to be able to operate more smoothly at higher stack speeds. By way of explanation, it will be recalled that in order to accommodate slow stack speed operation, e.g., less than 20 inches per minute, it is desirable that each stitch command initiate a very rapid needle stroke to avoid the needle interfering with stack movement. As the stack translation speed and needle stroke rate increase, the needle's interference with stack movement diminishes. Thus, at fast stack speeds, e.g., greater than 20 inches per minute (or 200 stitches per minute assuming an exemplary 0.1 inch stitch length), it is appropriate to switch to a proportional mode in which the needle is continuously driven at a rate substantially proportional to the speed of stack translation. At a speed of 200 stitches per minute, each needle cycle consumes less than about 300 milliseconds. Accordingly, the algorithm depicted in FIG. 7(B) includes a step which tests for the time duration between successive stitch commands, i.e., a stitch time interval. If the duration of this interval is less than an exemplary 300 milliseconds, then operation proceeds in the proportional mode. FIG. 7(B) shows that block 138 is followed by block 152 which reads and resets a stitch interval timer (which can be readily implemented by a suitable microcontroller) which times the duration between successive stitch commands and records the angular position en of the needle drive shaft 60 (block 153). Decision block 154 then tests the interval timer duration previously read in block 152 to determine whether it is greater than the aforementioned exemplary 300 millisecond interval. If yes, operation proceeds to the impulse mode 155. If no, operation proceeds to the proportional mode 156.

Operation in the impulse mode 155 involves block 157 which is executed to assure deactivation of the proportional mode. Thereafter, block 148 is executed which involves waiting for a signal from the bobbin hook sensor. The motor (or clutch) is then actuated in block 142 and actuation terminates when a terminating pulse is recognized from the shaft position sensor (block 146). Block 158 then deactuates a motor/clutch relay and/or actuates a brake after a stitch recognized in block 146 to park the needle in its up position.

Operation in the proportional mode 156 includes step 159 which activates motor speed control operation. A motor speed control capability is a common feature of most modern sewing machines with motor speed being controlled by the user, e.g., via a foot pedal, and/or by built-in electronic control circuitry.

After block 159, decision block 160 is executed. To understand the function of decision block 160, it must first be recognized that as stack speed is increased, thus generating shorter duration stitch intervals, the shaft angle position $\Theta_n$ read in block 153 will decrease, in the absence of an adjustment of motor/needle shaft speed. In other words, a newly read shaft angle $\Theta_n$ will be smaller than a previously read shaft angle $\Theta_p$. Block 160 functions to compare $\Theta_n$ and $\Theta_p$ if stack speed increases. If $\Theta_n$ is smaller, the motor speed must be increased (block 161) to deliver stitches at an increased rate to maintain stitch length uniformity.

On the other hand, if stack speed is reduced so that $\Theta_n$ is greater than $\Theta_p$, motor speed is decreased (block 162) in order to produce uniform length stitches. If stack speed remains constant, then $\Theta_n$ equals $\Theta_p$ and no motor sped adjustment is called for (block 163).

The embodiments discussed thus far (FIGS. 1–7) contemplate use of a motion detector 64 for observing energy reflected from the top and/or bottom stack surfaces to produce signals representing stack translation along X and Y axes. A microcontroller functions to resolve these X and Y components to determine the magnitude of stack translation for controlling stitch head actuation as explained by FIG. 7. The present invention, depicted in FIGS. 8–14, is based on the recognition that the magnitude of stack translation can be alternatively determined by detecting the length of thread payout e.g., from the hook and bobbin assembly 52.

Figure 8:
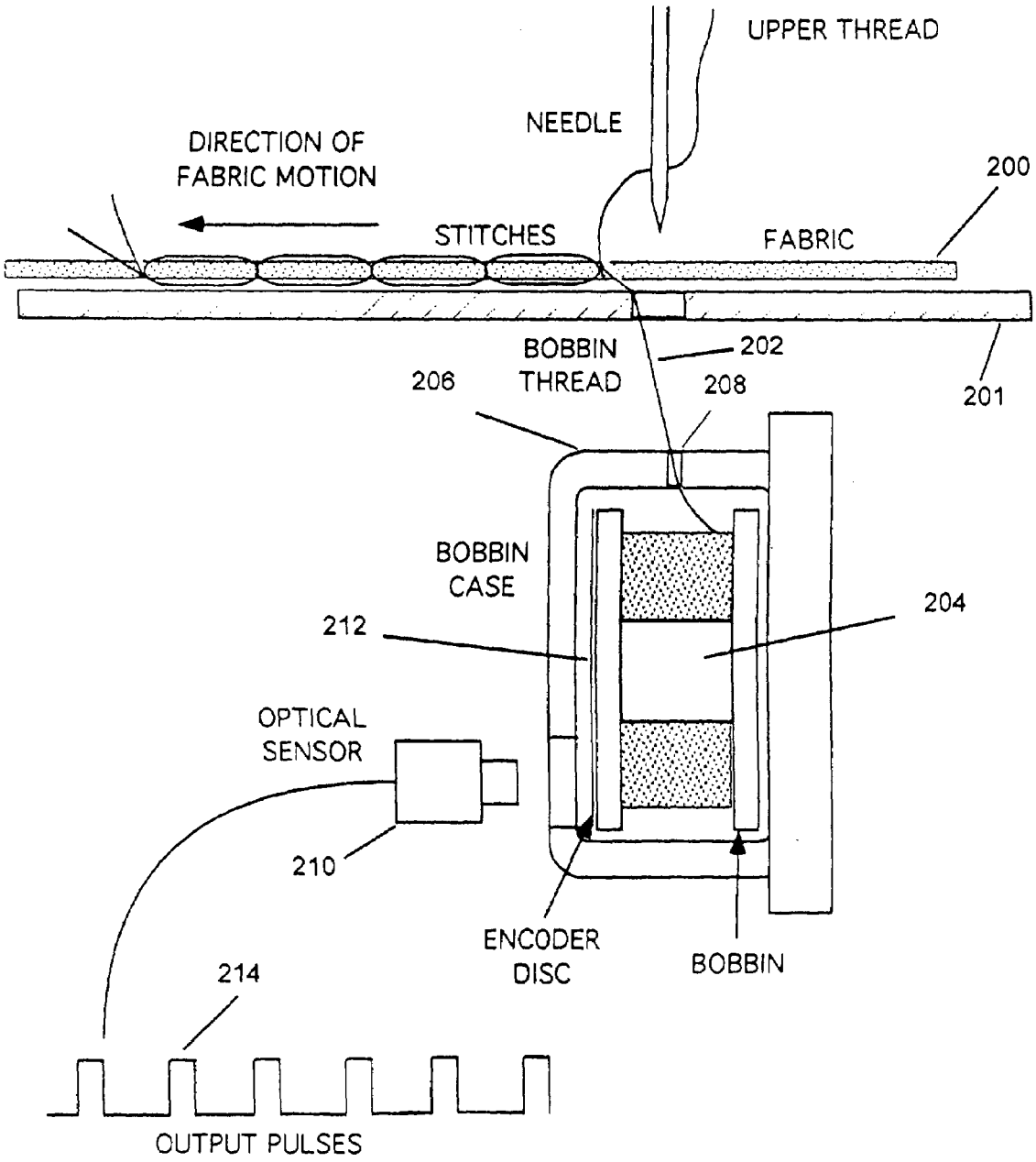
FIG. 8 is a block/schematic diagram showing a first embodiment of the present invention including means for detecting bobbin thread payout for controlling stitch head actuation.

Attention is now directed to FIG. 8 which illustrates a first embodiment in accordance with the present invention. As the fabric stack 200 is moved by the user along planar surface 201, bottom thread 202 is pulled from the bobbin 204 and out of the bobbin case 206 via opening 208. The thread pulled, i.e., paid out, from the bobbin 204 causes the bobbin to rotate about its axis. Thus, the angular rotation of the bobbin represents a measure of the length of bobbin thread payout. The bobbin angular rotation can be measured by a detector 210, e.g., an optical sensor, operating in conjunction with an encoder disc 212 attached to a side face of the bobbin 204. The detector 210 will produce electrical pulses 214 by detecting segment marks 215 of the encoder disc 212 as the bobbin rotates (FIGS. 9, 10). Each pulse represents an increment of bobbin angular rotation and an increment of thread length pulled from the bobbin which in turn represents an increment of stack movement. These pulses 214 are applied to control circuitry (FIG. 13) which issues a stitch command when the stack movement exceeds a certain threshold.

FIG. 9 illustrates the segmented encoding disc 212 attached to the side face of a conventional bobbin 204. A typical bobbin has an inner thread circumference of about 25 mm and an outer thread circumference of about 50 mm. A practical encoding disc has a total of 100 segments. Thus, when the active thread layer on the bobbin has a circumference of 50 mm and the stitch length is selected as 2.5 mm, then five disc segments are equivalent to paying out thread for a single stitch. That is, it is desirable for the control circuitry (FIG. 13) to produce a stitch command after every fifth output pulse 214.

FIG. 10 illustrates bobbin case 206 having a window 216 through which segments 215 of the encoder disc 212 can be seen by the optical sensor 210 as the bobbin 204 rotates.

As thread 202 unwinds from the bobbin 204, the circumference of the active thread layer decreases and the ratio of stack movement to pulse generation will increase. That is, with a constant rate of stack motion and using the aforementioned bobbin parameters, a near empty bobbin will rotate twice as fast as a full one. Thus, output pulses will be produced at twice the rate. If five output pulses generated when the bobbin is full produces a stitch length of about 2.5 mm, then five output produced by a near empty bobbin would produce a stitch length of about 1.25 mm. Deviation of stitch length over the capacity of the bobbin from a nominal 1.87 mm, is then approximately plus or minus 34%. Although this deviation may be tolerable in certain situations, it is preferable to provide some means for minimizing or correcting for this variation.

The aforediscussed deviation attributable to the diminishing thread circumference on the bobbin can be reduced by reducing the ratio of full-to-empty thread circumferences. For example, if the inner diameter of the bobbin is increased so that the near empty circumference becomes ¾ rather than ½ that of the full bobbin circumference, then the full-to-empty stitch length ratio improves to 1.37:1 rather than 2:1. With this arrangement the bobbin retains nearly 70% of the total thread capacity available on the referenced bobbin, but the deviation of stitch length from nominal is less than plus or minus 15% over the full range of bobbin thread payout.

It is noted that arbitrarily small deviations of stitch length can be achieved with further reduction of the ratio of outer to inner bobbin diameters. When the diameters are selected so that the thread available is half that of the aforediscussed bobbin, the deviation becomes less than plus or minus 10%.

The stitch length variation attributable to diminishing thread circumference can be further mitigated by introducing a correction factor that is developed by measuring the amount of thread remaining on the bobbin. To illustrate, the typical bobbin has a thread layer circumference of about 50 mm when full diminishing to about 25 mm when near empty. Assuming a nominal stitch length of 2.5 mm and a 100-segment encoder, when the bobbin is full, stitches are triggered on each fifth pulse. When the bobbin is near empty, a correction factor of 2.0 can be applied to cause stitches to be triggered on each tenth pulse. Similarly, interpolated correction factors can also be developed and applied as the bobbin thread diameter gradually decreases. Techniques for determining and reporting the amount of thread remaining on a bobbin are known in the art and can be readily employed to apply these correction factors.

In an alternate method of developing the correction factors, a counter can record the total number of stitches taken from the bobbin since it was last filled. That number bears an inverse mathematical relationship to the current thread circumference. Consequently, it can be used to develop the correction factor.

Figure 11:
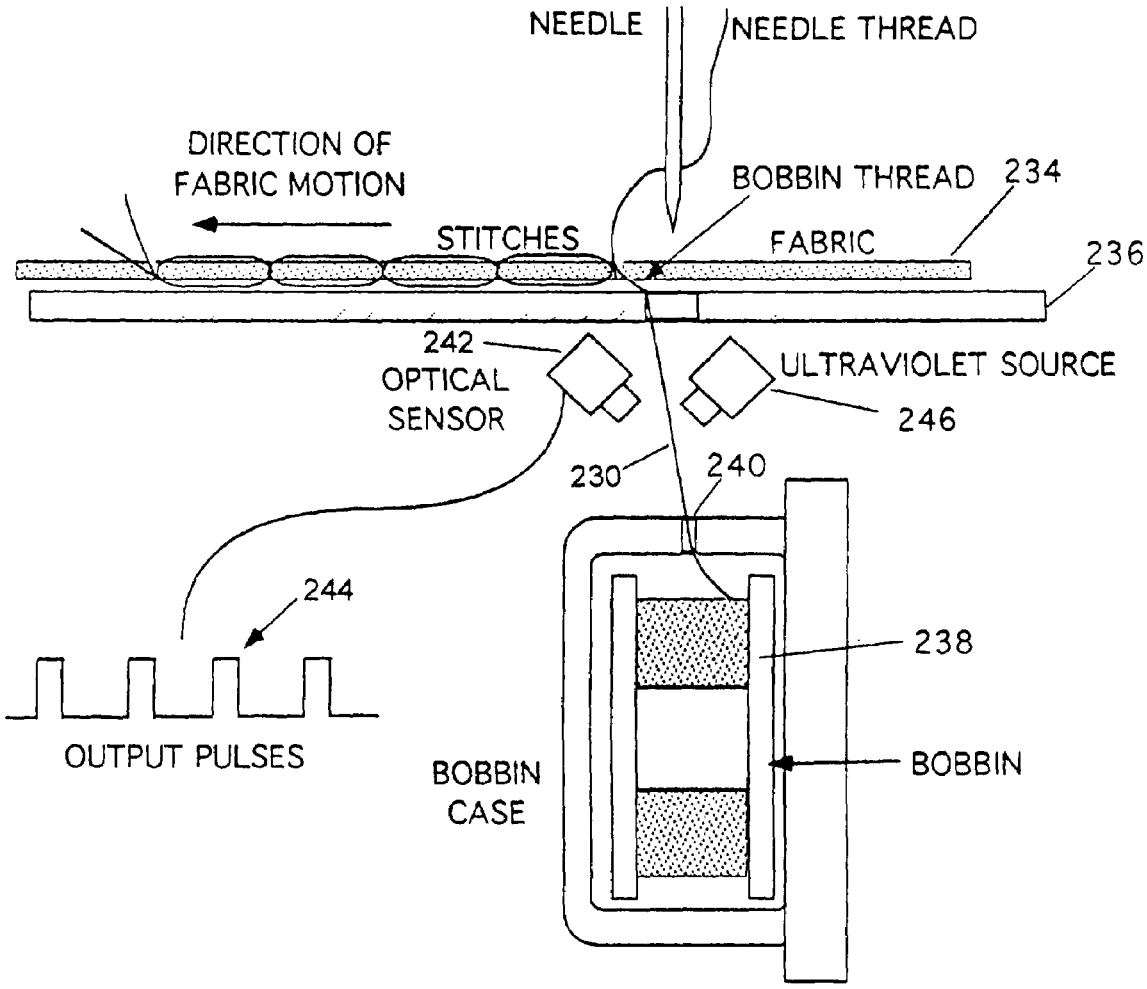
FIG. 11 is a block/schematic diagram showing a second embodiment of the present invention in which bobbin thread payout is measured by reading markings or characteristics of the thread.
Figure 12:
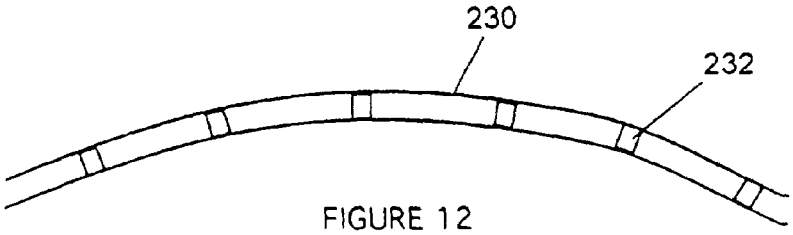
FIG. 12 depicts an exemplary thread length marked with fluorescent bands for use in the embodiment of FIG. 11 to enable the length of thread payout to be easily measured.

In a further alternative embodiment, represented in FIGS. 11 and 12, bobbin thread payout is measured by detecting uniformly spaced features, or marks, of the thread itself, or marks added to the thread to facilitate detection. FIGS. 11 and 12 assume a bobbin thread 230 carrying "readable" marks 232 uniformly spaced along the length of the thread. As the fabric stack 234 is moved along planar surface 236, thread 230 pays out from bobbin 238 emerging from case opening 240. The marks 232 can be read by a detector 242, e.g., an optical sensor, mounted near the opening 240 to produce the pulses 244. In a preferred embodiment, the marks 232 comprise bands material normally invisible to the human eye but which become visible when illuminated by an appropriate source, e.g., ultraviolet light. As each band 232 emerges from the bobbin case through opening 240, it is preferably illuminated with ultraviolet light from source 246. Each band is thus energized to produce visible light which can be detected by the optical sensor 242. The optical sensor 242, produces the pulse train 244 used by the circuitry of FIG. 13 to generate stitch commands.

Figure 13:
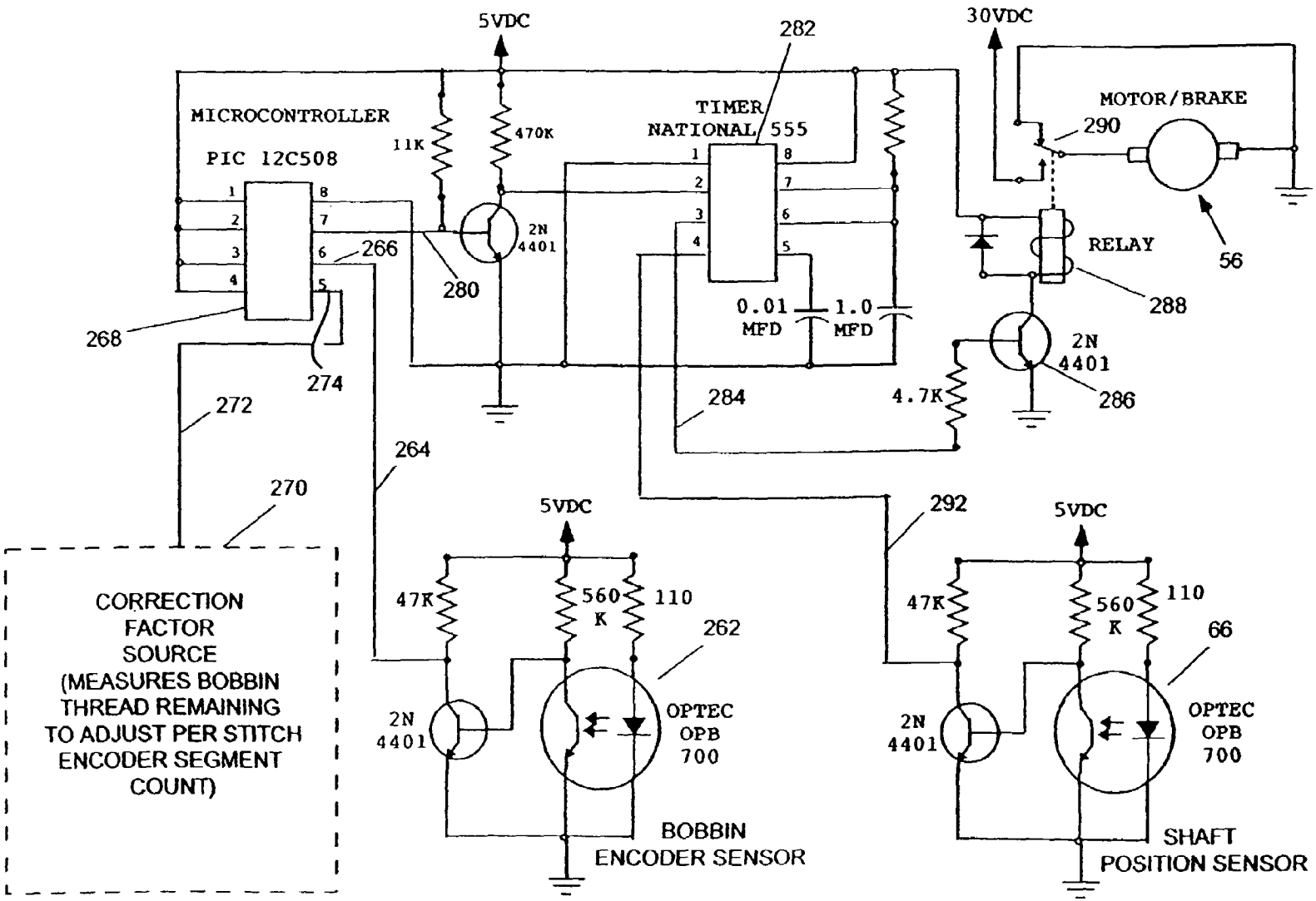
FIG. 13 is a circuit diagram illustrating control circuitry for responding to the output pulses produced by the embodiments of FIGS. 8 or 10 for actuating the stitch head.

Attention is now directed to FIG. 13 which illustrates control circuitry 260 for responding to the pulse signals produced in FIGS. 8 or 11 to actuate the stitch head via motor/brake assembly 56. Note that FIG. 13 depicts optical sensor 262 (which corresponds to optical sensors 210 and 242 of FIGS. 8 and 11, respectively) for providing output pulses at a rate related to the rate of bobbin thread payout. The output pulses produced by sensor 262 are coupled via line 264 to a data input 266 of a microcontroller 268 (e.g., microcontroller chip Microchip PIC 12C508). A source 270 of the previously discussed correction factors also supplies data via line 272 to microcontroller data input 274.

In operation, the microcontroller 268 functions to count the pulses provided by sensor 262 in order to recognize when a preset, but variable, increment, i.e., threshold length, of the bobbin thread has paid out. The number of pulses required to reach the threshold increment is dependent on the correction factor data provided by source 270, as has been previously described. When the microcontroller 268 recognizes that the threshold has been reached, it issues a signal via output 280 to timer circuit 282. The timer circuit 282 then provides a stitch command signal on output 284 to load transistor 286. Transistor 286 controls relay 288 which is shown as operating a single pole double, throw switch 290. In the actuated lower position, switch 290 applies power to drive the motor of motor/brake assembly 56 of FIG. 2. The relay 288 is deactuated via the timer 282 and the transistor 286 by a pulse on line 292 from the aforementioned shaft position sensor 66 (FIG. 2). In the deactuated upper position, switch 290 closes a shunt path around the motor 56 to thus brake the drive train and park the needle in its up position.

Figure 14A:
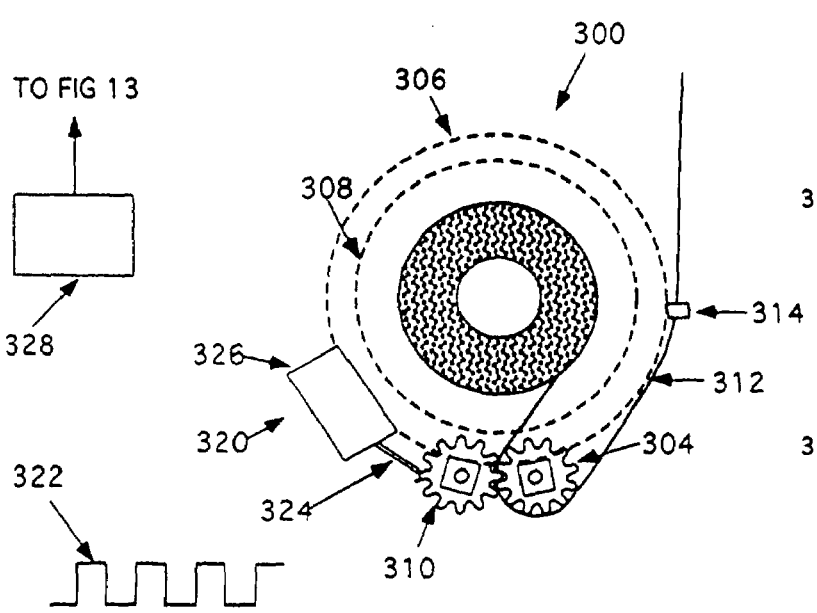
FIGS. 14A, 14B, and 14C comprise front, side, and bottom views of an alternative embodiment in which the thread rotates a toothed idler pulley as it pays out from the bobbin.
Figure 14B:
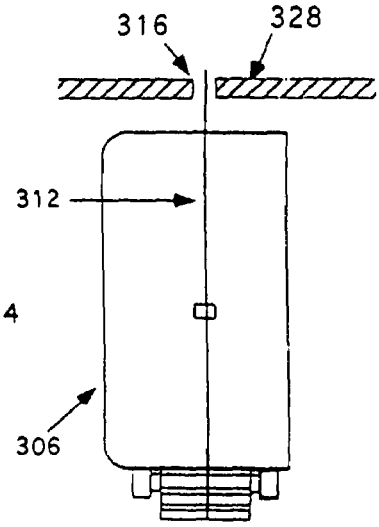
Figure 14C:
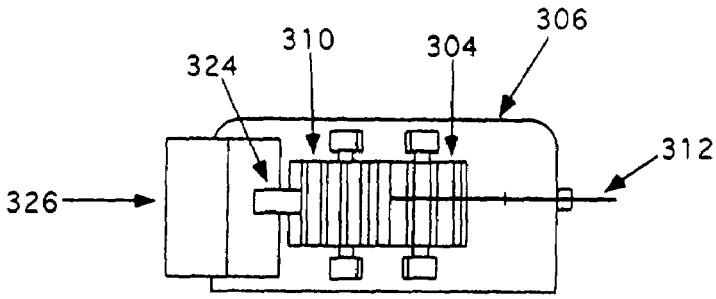

Attention is now directed to FIGS. 14A, 14B, 14C which illustrate a further embodiment 300 for detecting a threshold increment of thread as it pays out from the bobbin. The embodiment 300 employs an idler pulley 302, in the form of a toothed gear 304, mounted adjacent to a bobbin case 306 housing a bobbin 308. The gear 304 engages a second toothed gear 310. The thread 312 exiting from bobbin case 306 passes between and engages the teeth of the gears 304, 310 which are closely shaped and dimensioned to prevent thread slippage relative to the gears. After passing between gears 304, 310, the thread 312 is directed by suitable guides 314 to the needle opening 316 in plate 318. Thus, as the thread 312 pays off the bobbin 308, to form stitches above plate 318, it synchronously rotates meshed gears 304 and 310.

Detector 320 is provided to detect the incremental angular rotation of the gears 304, 310 and produce an output pulse train 322 analogous to previously mentioned pulse trains 214 (FIG. 8) and 244 (FIG. 11). The detector 320 includes a sensing member 324 which responds to each tooth of gear 310 moving therepast. The sensing member 324 can most simply comprise a mechanical follower which physically contacts the teeth of gear 310 to generate an electrical signal and produce an output pulse as the high point of each gear tooth moves therepast. The sensing member 324 can alternatively comprise a contactless member capable of recognizing the proximity of a gear tooth by responding to its magnetic, capacitive, or optical characteristics to produce an output pulse.

The output pulse train 322 produced by the sensing member 324 in response to the thread 312 rotating gears 304, 310 is coupled to the data input (e.g., 266) of the control circuitry of FIG. 13. Preferably, the pulse train 322 is wirelessly communicated to the control circuitry using a transmitter 326 located proximate to the sensing member 324 and a receiver 328 connected to the control circuitry of FIG. 13.

The transmitter 326 can be implemented in a variety of ways, for example, as a battery operated RF or IR transmitter. Preferably, however, the transmitter 326 comprises a passive device configured for remote powering by an inductive coil.

Although the embodiment 300 of FIGS. 14A, 14B, and 14C shows the thread 312 extending between and contacting both of the meshed gears 304, 310 to avoid thread/gear slippage, it is recognized that this result can be achieved with a variety of different mechanisms. For example only, a spring urged arcuate guide member can be used to hold the thread against the peripheral surface of a toothed drum (analogous to gear 304) so that as the thread is pulled by the fabric stack, it incrementally rotates the toothed drum. By counting the movement of teeth past a detector, the thread payout length can be determined to control needle speed.

From the foregoing, it should now be appreciated that a stitch head (e.g., 28 in FIG. 2) can be controlled in response to the detected length of thread payout to produce stitches of uniform length in a fabric stack manually guided beneath the stitch head. The control can be exercised in either an impulse mode or a proportional mode or a dual mode system. It should be understood from the prior discussion that operation in the impulse mode produces a single stitch for each threshold unit of stack movement, i.e., each unit of threshold length of thread payout. In the proportional mode, the needle cycles at a rate proportional to the rate of stack movement, i.e., the rate of thread payout. Dual mode operation contemplates use of the impulse mode at slow stack speeds and the proportional mode at higher stack speeds. Although the preferred embodiments specifically described herein show bottom thread payout detection for controlling needle cycle rate, or speed, it should be understood that equivalent embodiments could alternatively detect top thread payout.

It should also be understood that although it is preferable to incorporate thread payout detection as an integral part of a sewing/quilting machine, it is recognized that an existing conventional sewing machine can be modified, or retrofitted, to incorporate this function by exercising control of the stitch head via the normal foot pedal input. For example, the transistor 286 (FIG. 13) can control motor speed via the foot pedal input in the manner shown in FIG. 16 of Applicant's aforementioned U.S. Pat. No. 6,883,446.

The invention claimed is:

1. A machine for stitching at least one fabric layer, said machine comprising:

an upper arm and a lower arm mounted in vertically spaced substantially parallel relationship to define a throat space therebetween, a substantially horizontally oriented plate mounted proximate to said lower arm for supporting said fabric layer for guided movement in said throat space;

a needle arm supported from said upper arm actuatable to reciprocally move a needle substantially perpendicular to said plate for piercing said fabric layer with a top thread paid out through said needle;

means for paying out a bottom thread beneath said plate in accordance with the movement of said fabric layer;

means operable to loop said top thread inserted through said layer around said bottom thread;

detector means for detecting an increment of thread payout; and control means responsive to said detected increment of thread payout for actuating said needle arm.

2. The machine of claim 1 wherein said means for paying out said thread comprises a bobbin mounted for rotation; and wherein said detector means comprises means for measuring the angular rotation of said bobbin.

3. The machine of claim 2 wherein said detector means includes an encoder disc mounted on said bobbin for rotation therewith; and wherein said encoder disc carries detectable marks; and a sensor for detecting said detectable marks.

4. The machine of claim 2 wherein said detector means produces an output signal representative of the angular rotation of said bobbin; and means for producing a correction signal to compensate for changes in thread circumference on said bobbin.

5. The machine of claim 4 wherein:

said control means is responsive to said output signal and said correction signal for actuating said needle arm at a rate substantially proportional to the rate of bottom thread payout from said bobbin.

6. The machine of claim 1 wherein said detector means includes a sensor for detecting marks spaced along the length of said bottom thread.

7. The machine of claim 6 wherein said marks are normally invisible to the human eye.

8. The machine of claim 7 further including means for illuminating said marks; and wherein said sensor comprises an optical sensor.

9. The machine of claim 1 wherein said detector means produces an output signal representative of the length of bottom thread payout; and wherein said control means is responsive to said output signal for actuating said needle arm at a rate substantially proportional to the rate of bottom thread payout.

10. The machine of claim 9 wherein said output signal comprises a pulse train where each pulse represents a nominal length of bottom thread payout.

11. The machine of claim 1 further including an idler pulley configured to be rotated by said bottom thread pay out; and wherein said detector means produces an output signal representative of the angular 4 rotation of said idler pulley.

12. A quilting apparatus for forming successive stitches in a stack of one or more fabric layers, said apparatus comprising:

a bed defining a substantially horizontally oriented planar surface configured to support said stack for guided movement across said planar surface;

a needle mounted above said bed operable to execute successive cyclic movements each such movement including a needle-up position above said planar surface and a needle-down position piercing said stack to deliver a top thread paid out through said needle beneath said planar surface;

means mounted beneath said planar surface for paying out a bottom thread to form successive stitches with said top thread;

detector means for measuring the length of thread payout; and control means responsive to said detector means for causing said needle to execute cyclic movements at a rate substantially proportional to the rate of thread payout.

13. The apparatus of claim 12 wherein said detector means includes a sensor for detecting incremental lengths of bottom thread payout.

14. The apparatus of claim 12 wherein said means for paying out said bottom thread includes a bobbin mounted for rotation; and wherein said detector means includes a sensor for detecting increments of angular rotation of said bobbin.

15. The apparatus of claim 14 wherein said sensor produces an output signal representative of the angular rotation of said bobbin; and means for producing a correction signal to compensate for changes in thread circumference on said bobbin.

16. A method of forming successive stitches in a stack of one or more fabric layers, said method comprising;

providing a horizontally oriented planar surface for supporting said stack for guided movement across said planar surface;

causing a needle mounted above said planar surface to execute successive cyclic movements, each cyclic movement including a needle-up position above said planar surface and a needle-down position piercing said stack and delivering an increment of top thread paid out through said needle beneath said planar surface;

causing each top thread increment delivered beneath said planar surface to form a stitch with an increment of bottom thread paid out from a source of bottom thread; and causing said needle to execute said cyclic movements at a rate substantially proportional to the rate at which thread is paid out.

17. The method of claim 16 wherein said step of causing said needle to execute cyclic movements includes sensing the payout of said bottom thread.

18. The method of claim 16 wherein said bottom thread source comprises a bobbin mounted for rotation.

19. The method of claim 17 wherein said step of sensing the payout of said bottom thread includes detecting increments of angular rotation of said bobbin.

20. The method of claim 17 wherein said step of sensing the payout of said bottom thread includes detecting marks spaced along the length of said bottom thread.

21. A quilting apparatus for successively forming uniform stitches in a stack of one or more fabric layers, said apparatus comprising:

a bed defining a substantially horizontally oriented planar surface configured to support said stack for guided movement across said planar surface;

a needle mounted above said bed for cyclic movement between a needle-up position above said planar surface and a needle-down position piercing said stack to deliver a top thread paid out through said needle beneath said planar surface;

a bobbin assembly operable to pay out a bottom thread to form successive stitches with said top thread delivered beneath said planar surface;

a detector operable to measure the length of thread payout; and a controller responsive to said detector operable to cause said needle to execute cyclic movements at a rate substantially proportional to the rate of thread payout.

22. The apparatus of claim 21 wherein said detector is operable to measure bottom thread payout.

23. The apparatus of claim 21 wherein said detector is operable to measure top thread payout.

* * * * *